United States Patent [19]

Baisz et al.

[11] Patent Number: 4,846,733

[45] Date of Patent: Jul. 11, 1989

[54] ACCESSORY FUSE BLOCK

[75] Inventors: George J. Baisz, Downers Grove; Stephen A. Colleran, Lisle, both of Ill.

[73] Assignee: Lucas Electrical Electronic Systems Limited, England

[21] Appl. No.: 233,800

[22] Filed: Aug. 19, 1988

[51] Int. Cl.[4] ..... H01R 23/02; H01R 33/945

[52] U.S. Cl. ..... 439/622; 439/651

[58] Field of Search ..... 439/651, 652, 621, 622, 439/653, 654, 682, 691, 692, 693, 698; 337/197, 198

[56] References Cited

U.S. PATENT DOCUMENTS 4,097,109 6/1978 Cross ..... 439/622

4,306,158 12/1981 Ogle ..... 439/651

*Primary Examiner*—Gary F. Paumen

*Attorney, Agent, or Firm*—Andrus, Sceales, Starke & Sawall

[57] ABSTRACT

An accessory fuse block is provided for incorporating an electrical accessory into an automotive vehicle. The accessory fuse block comprises a housing and a plurality of terminals mounted therein. The terminals comprise a pair of spaced apart blade terminals for electrical connection to the fuse receiving terminals on the automotive vehicle. The accessory fuse block further comprises a pair of primary fuse receiving terminals which are in electrical connection to the respective blade terminals, and which are constructed to electrically engage the terminals of an automotive fuse. The fuse block further comprises a pair of accessory fuse receiving terminals which also are constructed to receive the terminals of an automotive fuse. A jumper is provided to electrically connect one accessory fuse receiving terminal to one blade terminal of the accessory fuse block.

12 Claims, 5 Drawing Sheets

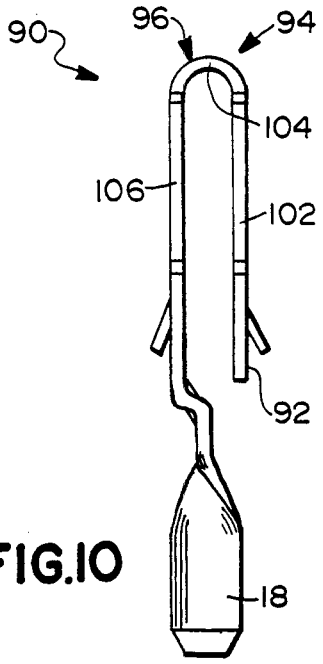
FIG.10
FIG.11
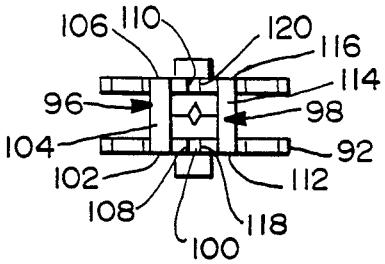
FIG.14
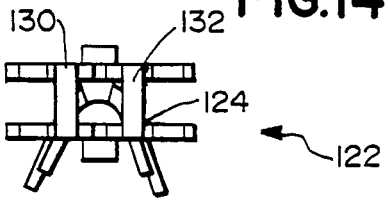
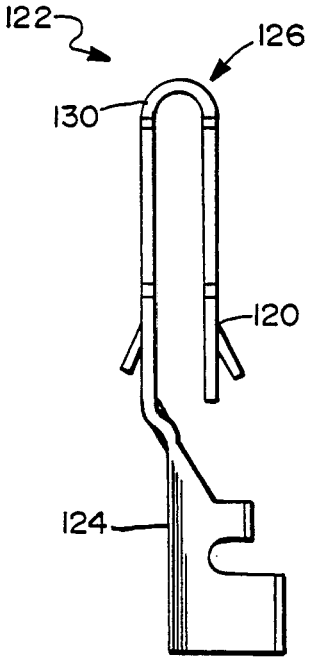
FIG.13
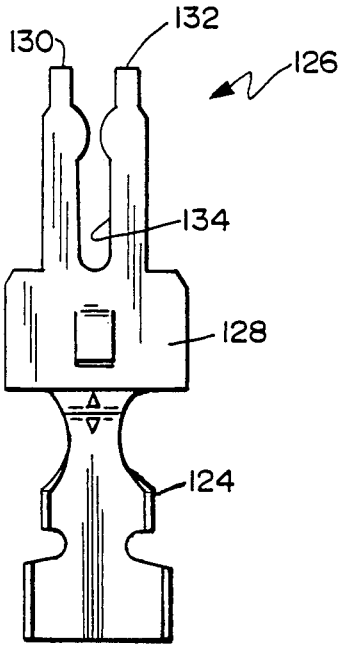
FIG.12

ACCESSORY FUSE BLOCK

BACKGROUND OF THE INVENTION

Automobiles and other vehicles comprise many independent electrical components which are powered by the battery and/or by the generator of the vehicle. Electrically operated components may include sound systems, temperature control systems, dash board indicators, external light groups, powered windows or locks, fuel injection systems, windshield wipers, defrosters and many other components. The various electronic circuits into which these components are incorporated include fuses to control the amount of current delivered to the components or conductors associated therewith and to prevent damage resulting from excess current loads.

The typical automotive fuse comprises a pair of spaced apart and generally planar blade terminals which are disposed to lie in generally a common plane. The blade terminals typically are connected to one another by a fuse wire which is manufactured to break if subjected to a current level in excess of a specified maximum. The fuse wire and portions of each blade terminal typically are mounted in a nonconductive housing, with opposed portions of each blade terminal extending from the housing. The automotive fuses are removably mountable in fuse blocks. In particular, the fuse block will comprise pairs of blade receiving terminals disposed in spaced relationship for receiving the blades of the automotive fuse. The spaced apart blade receiving terminals in each pair are connected to conductive leads of a circuit. The circuit is completed by insertion of the fuse into the blade receiving terminals. If the specified current level of the circuit is exceeded, the fuse wire will break, thereby interrupting the circuit and preventing damage.

Many times the owner of a vehicle will elect to install additional electrically powered accessories. Such accessories might include additional sound system equipment, external lighting groups or electrically operated gauges, to name a few. The accessory equipment desirably should be protected by fuses. However, the retrofitting of the original equipment guse box or other original equipment circuitry on the vehicle may often go beyond the technical capabilities of the vehicle owner. Installation of equipment without proper fuses can damage the equipment being installed. Additionally, alterations to the original equipment circuitry may void a new vehicle warranty and can damage portions of the original electronic system. Thus, for the installation of even simple electrical accessories, the vehicle owner may be required to employ a service facility authorized by the manufacturer of the original equipment. The original equipment supplier and its authorized dealers will generally charge extremely initated prices for even simple electrical work on a vehicle, and often will offer only a narrow range of approved accessories.

The prior art includes many fuse block structures. However, most of the relevant prior art is directed to particular constructions for original equipment fuse blocks. For example, U.S. Pat. No. 4,466,683 which issued to Ballarini on Aug. 21, 1984 shows a fuse block assembly that can be altered depending upon the number of circuits and fuses required. However, each modular component of the assembly shown in U.S. Pat. No. 4,466,683 must be incorporated directly into the electrical circuitry of the board onto which the fuse block is mounted. Thus, even though the fuse block shown in U.S. Pat. No. 4,466,683 can be expanded, significant revisions to the original equipment circuitry must be made.

U.S. Pat. No. 4,097,109 issued to Cross on June 27, 1978 and shows an original equipment terminal block that contemplates the possible addition of accessories. The original equipment terminal block includes a cavity into which a correspondingly configured electrical connector can be inserted. This electrical connector includes conductive leads that extend to the new accessory, and further includes a socket for receiving a fuse. The apparatus shown in U.S. Pat. No. 4,097,109 requires the specially constructed original equipment terminal block which contemplates the addition of possible accessories. Thus, the teaching of U.S. Pat. No. 4,097,109 would be of no help to the owner of a vehicle having electrical circuitry that was not previously constructed for accepting additional electrical connectors.

In view of the above, it is an object of the subject invention to provide an accessory fuse block to enable electrical accessories to be added to a vehicle.

It is another object of the subject invention to provide an accessory fuse block that can be incorporated into the electrical system of a vehicle without revisions to the original circuitry of the vehicle.

It is a further object of the subject invention to provide apparatus for safely installing accessory electrical equipment into a vehicle.

An additional object of the subject invention is to provide an accessory fuse block that can be plugged directly into the existing fuse block of a vehicle.

SUMMARY OF THE INVENTION

The subject invention is directed to an accessory fuse block which may comprise a pair of male terminals which are connectable to a pair of fuse receiving terminals of an automotive fuse block The male terminals may comprise a pair of spaced apart generally coplanar blade terminals which are engagable in the bladed fuse receiving terminals of an automotive fuse block.

The accessory fuse block further comprises a plurality of sockets having terminals for receiving automotive fuses The fuse receiving sockets of the accessory fuse block are adapted to receive at least one original equipment fuse and at least one accessory fuse. A plurality of the terminals in the fuse receiving sockets are electrically connectable to the male terminals of the accessory fuse block, and are thereby connectable to the original equipment fuse block of the vehicle. At least one terminal of the accessory fuse block assembly is electrically connectable to an electrical accessory on the vehicle.

The male terminals and the fuse receiving terminals of the accessory fuse block are mounted in a nonconductive housing. The housing may comprise a narrow base approximating the size of an automotive fuse. However, the housing may be enlarged at locations spaced from the base to permit a plurality of automotive fuses to be mounted therein For example, the housing may be of generally inverted L-shape or generally T-shaped configuration.

In a preferred embodiment, as explained further below, the accessory fuse block is adapted to accommodate a single automotive accessory. Thus, this preferred accessory fuse block may comprise four fuse receiving terminals for engaging two fuses, and may further comprise two male terminals for electrical connection with fuse receiving terminals on the original equipment automotive fuse block. Two of the four fuse receiving terminals define primary fuse receiving terminals, and are connected directly respectively to the two male terminals of the accessory fuse block. The primary fuse receiving terminals are disposed relative to one another to receive the terminals of an automotive fuse The remaining two fuse receiving terminals of the accessory fuse block define accessory fuse receiving terminals. One of the two accessory fuse receiving terminals is electrically connected to one of the primary fuse receiving terminals. The other of the accessory fuse receiving terminals is electrically connectable to the automotive accessory. The two accessory fuse receiving terminals are disposed relative to one another to receive the terminals of an automotive fuse, and are disposed relative to the primary fuse receiving terminals such that two separate automotive fuses can be received in the accessory fuse block.

Preferably the fuse receiving terminals of the accessory fuse block are constructed to receive the generally planar terminals of the typical automotive fuse. Additionally, each primary fuse receiving terminal may be unitary with a corresponding male terminal. One primary fuse receiving terminal may further be unitary with one accessory fuse receiving terminal. The remaining accessory fuse receiving terminal may comprise crimpable means for electrical connection to a lead from the accessory.

The accessory fuse receiving terminals and the primary fuse receiving terminals may each be stamped and formed from strips of metal. In particular, each fuse receiving terminal may comprise a pair of generally U-shaped contact structures defining a fuse receiving slot therebetween. Each U-shaped contact structure may comprise a pair of spaced apart arms and a connecting strip extending therebetween Each arm of the U-shaped contact structure may comprise an edge, with opposed edges defining the fuse receiving slot Additionally, each contact arm may comprise an arcuate convex contact edge extending into the fuse blade receiving slot. The arcuate contact edges on opposed sides of the blade receiving slot are spaced from one another a distance that requires the respective U-shaped contact structures to be biased away from one another as the fuse is inserted into the slot. The specific construction of these preferred terminals is explained and illustrated further below, and is further described in co-pending application entitled Electrical Terminal For Bladed Fuse.

BRIEF DESCRIPTION OF THE DRAWINGS

FIG. 10 is a side elevational view of the terminal shown in FIG. 9.

FIG. 11 is a top plan view of the terminal shown in FIGS. 9 and 10.

FIG. 12 is a front elevational view of a third terminal.

FIG. 13 is a side elevational view of the terminal shown in FIG. 12.

FIG. 14 is a top plan view of the terminals shown in FIGS. 12 and 13.

DETAILED DESCRIPTION OF THE PREFERRED EMBODIMENT

Figure 1:
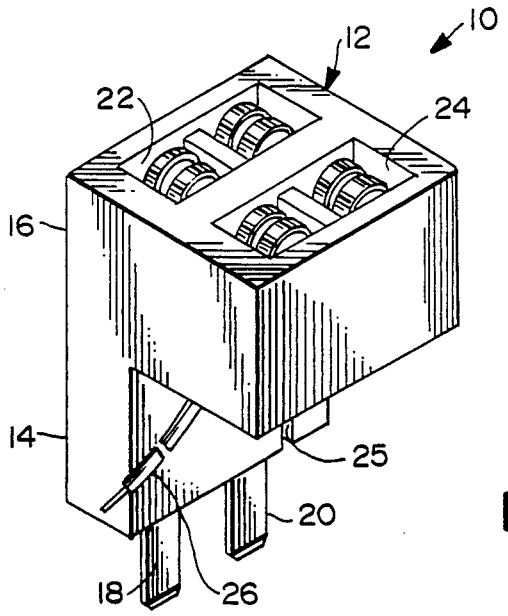
FIG. 1 is a perspective view of an accessory use block in accordance with the subject invention.
Figure 2:
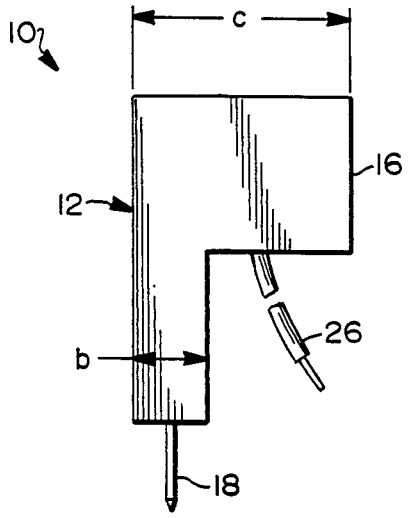
FIG. 2 is a side elevational view of the accessory fuse block shown in FIG. 1.

The accessory fuse block of the subject invention is identified generally by the numeral 10 in FIGS. 1–5. The accessory fuse block 10 comprises a nonconductive housing 12 which preferably is molded from a plastic material. The housing 12 comprises a base 14 having a width "a" and a depth "b" which approximate the dimensions of the plastic housing of an automotive fuse. The housing 12 of the accessory fuse block 10 further comprises a fuse receiving portion 16 which also has a width "a" which approximates the width of an automotive fuse. However, the fuse receiving portion 16 has a depth "c" which is approximately twice the depth "b" of the base 14.

The accessory fuse block 10 comprises a pair of blade terminals 18 and 20 extending from the base 14. More particularly, the blade terminals 18 and 20 are mounted in generally coplanar spaced apart relationship, with the dimensions of the blade terminals 18 and 20 and the spacing therebetween substantially corresponding to the dimensions and spacing of a standard automotive fuse. As a result, the blade terminals 18 and 20 of the accessory fuse block 10 are receivable in the original fuse block of an automobile.

The accessory fuse block 10 further comprises fuse receiving sockets identified generally by the numerals 22 and 24. The fuse receiving sockets 22 and 24 are disposed to receive two separate automotive fuses therein. As explained further below, the fuse receiving sockets 22 and 24 are provided with a plurality of terminals (not shown in FIGS. 1–5), selected ones of which are electrically connected to the blade terminals 18 and 20.

A slot 25 extends into the housing 12 from the base 14 thereof to the fuse receiving portion 16. As shown most clearly in FIG. 5, the slot 25 connects the fuse receiving sockets 22 and 24 and permits insertion of a terminal into the housing 12 as explained further below.

A conductive lead 26 extends into the housing 12 of the accessory fuse block 10 and is electrically connected to a terminal therein as explained further below. The lead 26 extends from an automotive accessory on the vehicle into which the accessory fuse block 10 is installed.

Figure 6:
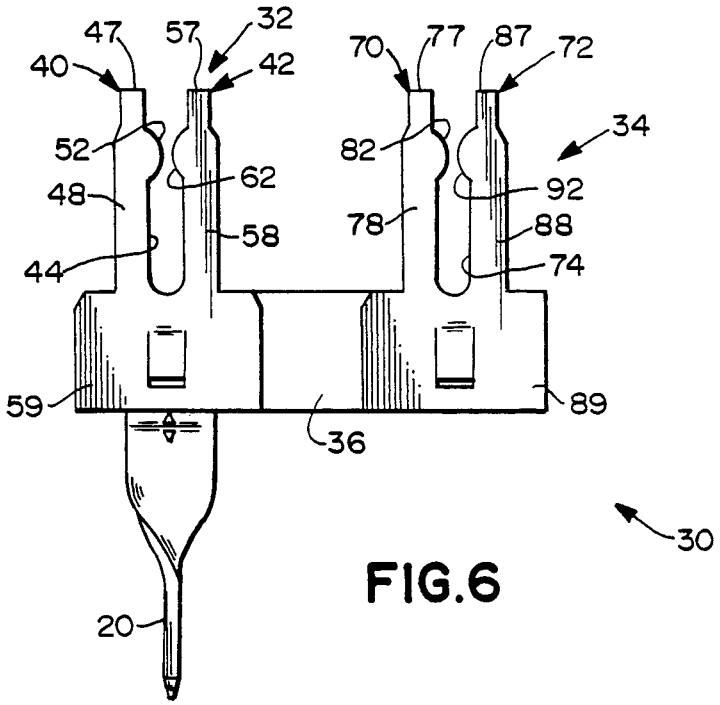
FIG. 6 is a front elevational view of a stamped and formed terminal of the accessory fuse block.
Figure 8:
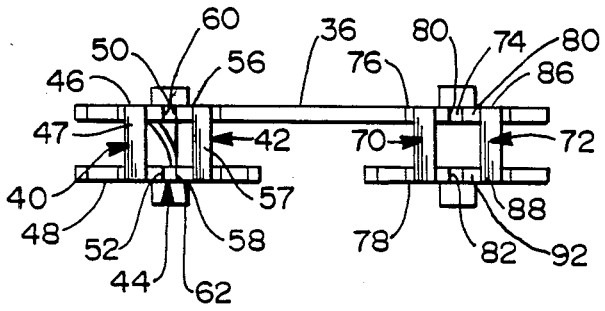
FIG. 8 is a top plan view of the terminal shown in FIGS. 6 and 7.
Figure 7:
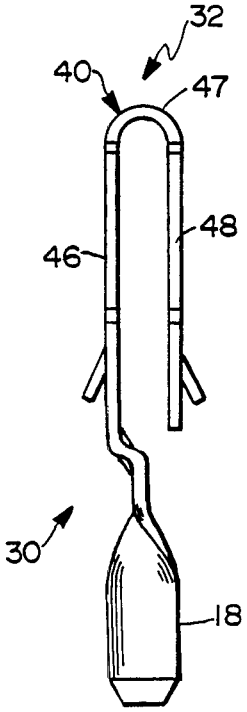
FIG. 7 is a side elevational view of the terminal shown in FIG. 6.

The terminals of the accessory fuse block are shown in greater detail in FIGS. 6–14. In particular, a jumper terminal 30 is illustrated in FIGS. 6–8. The jumper terminal 30 is stamped and formed from a unitary piece of conductive metal and includes the blade terminal 20 identified above and illustrated in FIGS. 1, 3 and 4. The blade 20 is twisted approximately 90° along its length as shown in FIGS. 6–8. The jumper terminal 30 further comprises a primary fuse receiving terminal structure 32 and an accessory fuse receiving terminal structure 34 which are connected to one another by a jumper 36. The jumper 36 is receivable in the slot 25 of the housing 12 as explained further below. The primary fuse receiving terminal structure 32 is defined by a pair of spaced apart generally U-shaped contact structures 40 and 42 which are disposed in spaced relationship to define a blade receiving slot 44 therebetween. In particular, the U-shaped contact structure 40 is defined by first and second contact arms 46 and 48 and a connecting strip 47 extending unitarily therebetween The first contact arm 46 of the U-shaped contact structure 40 is disposed in generally parallel alignment with the top portion of the blade 20 of the jumper terminal 30. The first contact arm 46 extends generally unitarily from and is coplanar with the jumper 36. The portion of the first contact arm 46 defining the blade receiving slot 44 is stamped and formed to define a convex arcuate contact edge 50. A similar convex arcuate contact edge 52 is disposed on the side edge of the second contact arm 48 defining the terminal receiving slot 44.

The U-shaped contact structure 42 is substantially identical to the U-shaped contact structure 40. More particularly, the U-shaped contact structure 42 includes a first contact arm 56 which extends unitarily from and parallel with the top of the blade 20 and is in register with the first contact arm 46 of U-shaped contact structure 40. The U-shaped contact structure 42 further comprises a second contact arm 58 and a connecting strip 57 extending between and connecting the first and second contact arms 56 and 58. The second contact arm 58 is unitarily connected to the contact arm 48 at mounting base 59 as shown most clearly in FIG. 6. The contact arms 56 and 58 of the U-shaped contact structure 42 are characterized by convex arcuate contact edges 60 and 62 in generally opposed relationship to the contact edges 50 and 52 of the U-shaped contact structure 40. The distance between the opposed contact edges 50 and 60 or 52 and 62 is less than the thickness of the fuse blade to be inserted into the fuse receiving slot 44. As a result, the insertion of the fuse blade into the fuse receiving slot causes the U-shaped contact structures 40 and 42 to be biased away from one another about axes extending generally orthogonal to the plane of the metal from which the jumper terminal 30 is stamped and formed. This biasing rotation of the U-shaped contact structures 40 and 42 creates substantial contact forces on the fuse blade inserted therein as described in greater detail in the above-identified co-pending application.

The accessory fuse receiving terminal 34 of the jumper terminal 30 is substantially identical to the primary fuse receiving terminal 32 described above. More particularly, the accessory fuse receiving terminal 34 comprises generally U-shaped contact structures 70 and 72 defining a blade receiving slot 74 therebetween. The U-shaped contact structure 70 comprises a first contact arm 76 which extends from the jumper 36 and a second contact arm 78. Generally convex arcuate contact edges 80 and 82 are defined on the contact arms 76 and 78 respectively. Similarly, the U-shaped contact structure 72 comprises a first contact arm 86 extending from the jumper 36 and a second contact arm 88 which is unitarily connected to the contact arm 78 at mounting base 89.

The jumper terminal 30 is disposed in the housing 12 of the accessory fuse block 10 such that the fuse receiving terminals 32 and 34 thereof define portions of the primary and accessory fuse sockets 22 and 24 respectively, with the jumper 36 creating a parallel connection between two fuses inserted into the sockets 22 and 24.

Figure 9:
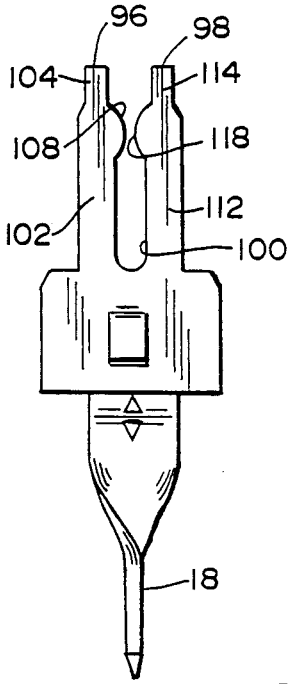
FIG. 9 is a front elevational view of a second terminal of the subject accessory fuse block.

A primary terminal 90 is shown in FIGS. 9–11. The primary terminal 90 is stamped and formed from a unitary piece of metal and comprises a blade terminal 18, which, as depicted in FIG. 1, extends from the base 14 of the housing 12. The blade terminal 18 is twisted 90° along its length to be disposed in generally coplanar spaced apart relationship with the blade terminal 20. The primary terminal 90 further comprises a mounting portion 92 extending from he blade 18 and a blade receiving terminal structure 94 extending unitarily from the mounting portion 92. The blade receiving terminal structure 94 of the primary terminal 90 is substantially identical to the blade receiving terminal structures 32 and 34 of the jumper terminal 30. In particular, the blade receiving terminal structure 94 of the primary terminal 90 comprises a pair of spaced apart generally U-shaped contact structures 96 and 98 defining a blade receiving slot 100 therebetween.

The U-shaped contact structure 96 of the primary terminal 90 is defined by a first contact arm 102 extending unitarily from the mounting portion 92. A connecting strip 104 extends from the first contact arm 102, and in turn extends into a second contact arm 106. The edges of the contact arms 102 and 106 of the U-shaped contact structure 96 defining the blade receiving slot 100 are characterized by arcuate convex contact edges 108 and 110 respectively.

The U-shaped contact structure 98 comprises a first contact arm 112 extending unitarily from the mounting portion 92, a connecting strip 114 extending from the first contact arm 112 and a second contact arm 116. The contact arms 112 and 116 of the U-shaped contact structure 98 defining the blade receiving slot 100 are characterized by convex arcuate contact edges 118 and 120 respectively which are disposed in opposed relationship to the contact edges 108 and 110. As described with respect to the jumper terminal 30, the distance between the contact edges 108 and 118 or 110 and 120 is less than the thickness of the fuse terminal to be inserted into the slot 100. As a result, the U-shaped contact structures 96 and 98 will be biased away from one another upon insertion of the fuse into the slot 100. It will be appreciated that the blade receiving slot 100 of the primary terminal 90 will be disposed in substantially coplanar relationship to the blade receiving slot 44 of the jumper terminal 30 in the accessory fuse block 10.

The accessory terminal is illustrated in FIGS. 12–14, and is identified generally by the numeral 122. The accessory terminal 122 includes a crimpable contact structure 124 at one end thereof, a fuse blade receiving terminal 126 at the opposed end and a mounting portion 128 therebetween. The crimpable contact structure 124 is constructed to be engaged about and make electrical contact with a conductive lead extending from an automotive accessory. Other types of contact structures ior engaging the conductive lead from the accessory could be incorporated into the accessory terminal 122. The fuse blade receiving contact portion 126 of the terminal 122 is substantially identical to those previously described. For simplicity, it will merely be noted that the fuse blade receiving contact portion 126 comprises a pair of U-shaped contact structures 130 and 132 defining a blade receiving slot 134 therebetween. The particular construction of each U-shaped contact structure 130 and 132 and the dimensions of the narrow portion of the slot 134 are substantially as explained in detail above.

Figure 15:
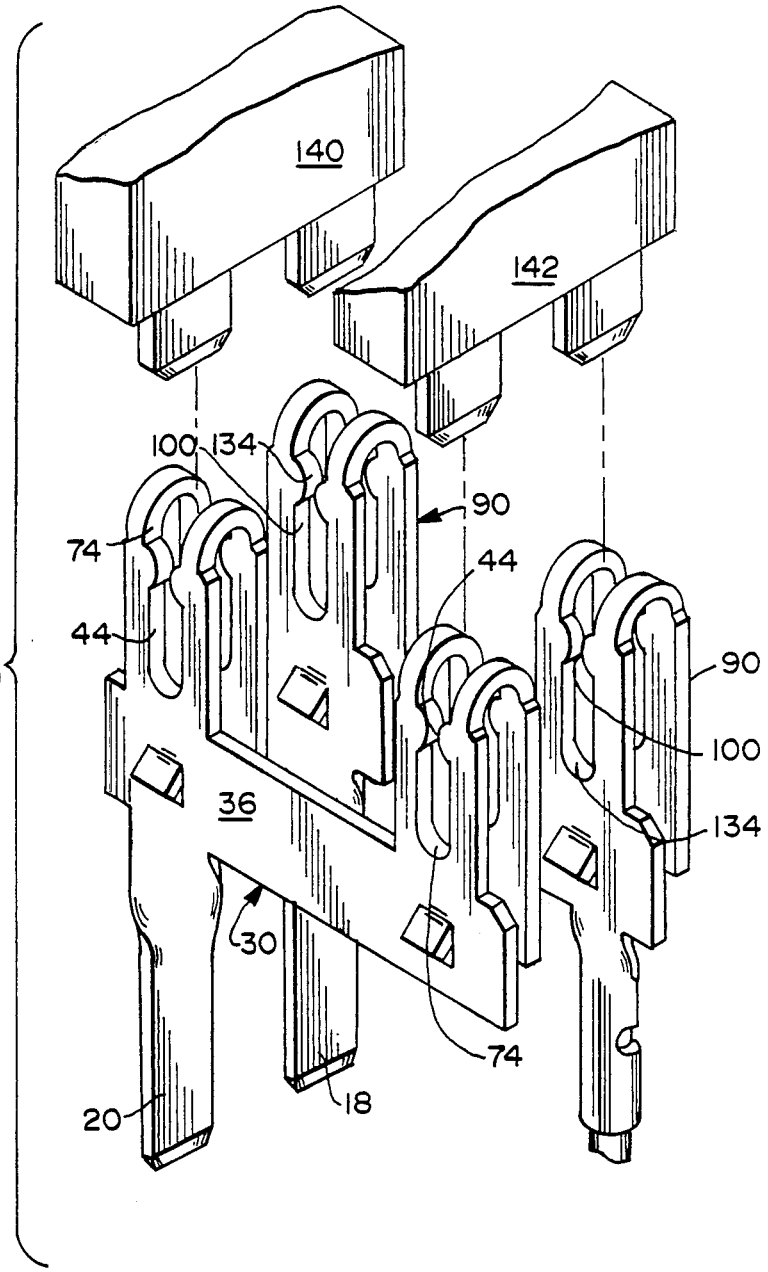
FIG. 15 is an exploded perspective view showing the terminals of the fuse block in their preferred relative positions to one another and to a pair of fuses.

The terminals of the accessory fuse block 10 are oriented with respect to one another as illustrated in FIG. 15. In particular, the terminals are oriented such that the blade 18 of the primary terminal 90 is in generally coplanar relationship to the blade 20 of the jumper terminal 30. Additionally, the blade receiving slots 100 and 44 are disposed in generally coplanar relationship for receiving the blades of an automotive fuse which is indicated generally by the numeral 140 in FIG. 15. The accessory terminal 122 is aligned such that the blade receiving slot 134 thereof is generally in coplanar relationship to the blade receiving slot 74 of the jumper terminal 30. This coplanar relationship of the blade receiving slots 134 and 74 enables an accessory automotive fuse 142 to be inserted therein as shown in FIG. 15.

Figure 3:
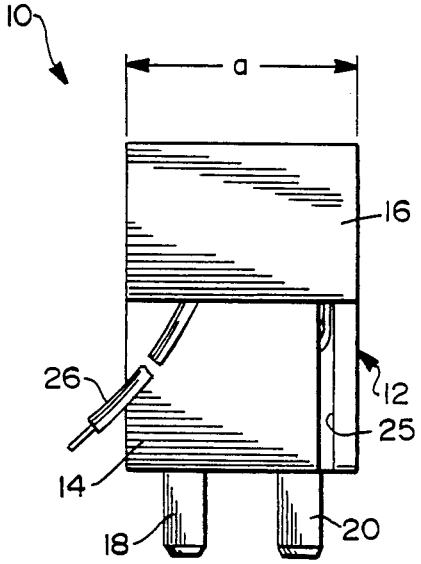
FIG. 3 is a front elevational view of the accessory fuse block.
Figure 4:
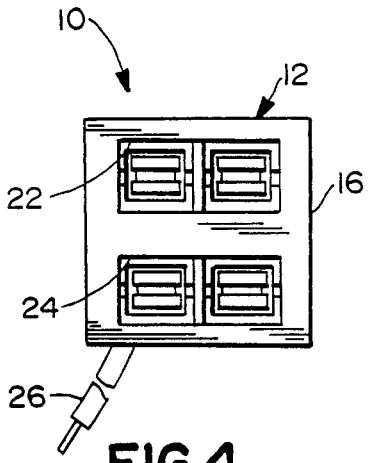
FIG. 4 is a top plan view of the accessory fuse block.
Figure 5:
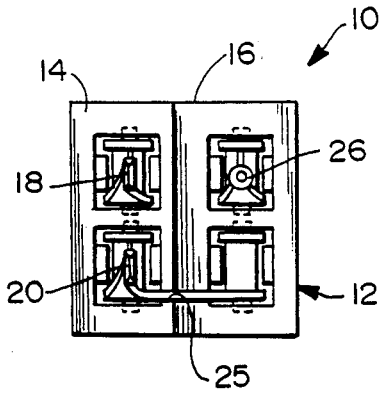
FIG. 5 is a bottom plan view of the accessory fuse block.

It will be understood that the terminals 30, 90 and 122 are lockingly inserted with the housing 12 from the bottom, with the jumper 36 being received in the slot 25 of the housing 12 as shown most clearly in FIGS. 3 and 5.

In use, the accessory fuse block 10 is inserted into the primary fuse block of an automobile such that the blades 18 and 20 of the accessory fuse block 10 are urged into the blade receiving terminals of the primary fuse block. The primary automotive fuse 140 and the accessory automotive fuse 142 then are inserted into the terminals of the accessory fuse block 10 as illustrated in FIG. 15. The accessory fuse block 10 does not require any rewiring of the original equipment circuitry on the vehicle, yet provides adequate protection ior the circuitry and the electrical components incorporated into the circuitry.

While the invention has been described with respect to a preferred embodiment, it is apparent that various changes can be made without departing from the scope of the invention as defined by the appended claims.

I claim:

1. An accessory fuse block for an automotive vehicle, said vehicle having a pair of terminals for receiving a fuse, said accessory fuse block comprising:

a pair of spaced apart male terminals dimensioned and disposed for electrical engagement with the fuse receiving terminals of the automotive vehicle;

a pair of spaced apart primary fuse receiving terminals electrically connected respectively to the male terminals and dimensioned and disposed for electrical connection to an automotive fuse; and a pair of spaced apart accessory fuse receiving terminals disposed and dimensioned ior electrical connection to the terminals of a second automotive fuse, one said accessory fuse receiving terminal being electrically connected to one said male terminal, the other of said accessory fuse receiving terminals being electrically connectable to an automotive accessory and not being electrically connected to the other said male terminal.

2. An accessory fuse block as in claim 1 wherein each said primary fuse receiving terminal is of unitary construction.

3. An accessory fuse block as in claim 2 wherein each said primary fuse receiving terminal and the male terminal connected thereto are of unitary construction.

4. An accessory fuse block as in claim 3 wherein said one accessory fuse receiving terminal and the male terminal electrically connected thereto are of unitary construction.

5. An accessory fuse block as in claim 1 further comprising a nonconductive housing, said male terminals extending from said nonconductive housing and said primary fuse receiving terminals and said accessory fuse receiving terminals being disposed generally within said nonconductive housing.

6. An accessory fuse block as in claim 5 wherein said nonconductive housing comprises a generally rectangular base and a generally rectangular socket portion, said socket portion being approximately twice as large as said base.

7. An accessory fuse block as in claim 1 wherein each of said primary fuse receiving terminals and said accessory fuse receiving terminals is substantially identical.

8. An accessory fuse block as in claim 7 wherein said primary fuse receiving terminals and said accessory fuse receiving terminals each comprise a pair of spaced apart generally U-shaped contact structures with a blade receiving slot being defined between each said pair of spaced apart U-shaped contact structures.

9. An accessory fuse block as in claim 8 wherein the distance between the U-shaped contact structures in each said pair of U-shaped contact structures is less than the thickness of the fuse terminal to be inserted therein, such that the U-shaped contact structures in each said pair of U-shaped contact structures are biased away from one another upon insertion of the fuse terminal therein.

10. An accessory fuse block for adding at least one electrical accessory to an automotive vehicle having a primary fuse block with at least one pair of use receiving terminals therein, said accessory fuse block comprising:

a nonconductive housing;

a pair of spaced apart coplanar blade terminals extending from said housing, said blade terminals being disposed and dimensioned for electrical connection to the fuse receiving terminals of the vehicle;

a primary fuse receiving socket formed in said housing and comprising a pair of spaced fuse receiving terminals therein, said fuse receiving terminals of said primary fuse socket being electrically connected respectively to the blade terminals extending from said accessory fuse block; and an accessory fuse receiving socket formed in said housing, said accessory fuse receiving socket comprising a pair of spaced apart accessory fuse receiving terminals, one said accessory fuse receiving terminal being electrically connected to one said blade terminal of said accessory fuse block, the other of said accessory fuse receiving terminals not being electrically connected to the other said blade terminal and comprising contact means for electrical connection to a conductive lead extending from the accessory.

11. An accessory fuse block as in claim 10 wherein the respective primary fuse receiving terminals are unitary with the corresponding blade terminals.

12. An accessory fuse block as in claim 11 wherein said one accessory fuse receiving terminal is unitary with the blade terminal electrically connected thereto.

* * * * *

UNITED STATES PATENT AND TRADEMARK OFFICE

CERTIFICATE OF CORRECTION

PATENT NO. : 4846733

DATED : July 11, 1989

INVENTOR(S) : George J. Baisz and Stephen A. Colleran

It is certified that error appears in the above-identified patent and that said Letters Patent is hereby corrected as shown below:

On the Title/Abstract page the incorrect Assignee "Lucas Electrical Electronic Systems Limited, England" should be deleted and in its place the correct Assignee -- Molex Incorporated -- should be added.

On the Title/Abstract page the incorrect attorney "Andrus, Sceales, Starke & Sawall" should be deleted and in its place the correct attorney -- Louis A. Hecht -- should be added.

Signed and Sealed this

Eighth Day of May, 1990

*Attest:*

HARRY F. MANBECK, JR.

*Attesting Officer*

*Commissioner of Patents and Trademarks*